US006164027A

United States Patent [19]

Ohlund

[11] Patent Number: 6,164,027

[45] Date of Patent: Dec. 26, 2000

[54] METHOD TO PRODUCE ELONGATED OBJECTS OF WOOD

[75] Inventor: Ulf Ohlund, Alvsbyn, Sweden

[73] Assignee: AB Alvsbyhus, Alvsbyn, Sweden

[21] Appl. No.: 09/381,411

[22] PCT Filed: Mar. 19, 1998

[86] PCT No.: PCT/SE98/00497

§ 371 Date: Oct. 18, 1999

§ 102(e) Date: Oct. 18, 1999

[87] PCT Pub. No.: WO98/41370

PCT Pub. Date: Sep. 24, 1998

[30] Foreign Application Priority Data

Mar. 19, 1997 [SE] Sweden ..... 9701015

[51] Int. Cl.[7] ..... B27D 1/00; E04C 1/00

[52] U.S. Cl. ..... 52/309.9; 52/309.15; 52/233; 144/347; 144/348; 156/264

[58] Field of Search ..... 52/233, 309.15, 52/DIG. 8, 309.9, 745.19; 138/157, 177; 156/264–292; 428/35.6, 80, 98; 144/346, 347, 348, 350

[56] References Cited

U.S. PATENT DOCUMENTS 4,394,409 7/1983 Hertel ..... 144/347

5,299,400 4/1994 Ding ..... 144/347

*Primary Examiner*—W. Donald Bray

*Attorney, Agent, or Firm*—Brooks & Kushman P.C.

[57] ABSTRACT

Procedure for producing elongated wooden objects, such as, for example, posts (10) used for frames, and elongated objects (10) produced according to the procedure. Rounded timber (1), preferably in the form of a log, is divided down its length along at least one cleaved cut (2), after which the two semi-circular sectional pieces of timber (4) are each bevelled (5) to an isosceles trapezium with its base comprising the cleaved cut (2) and with a nose angle that can be imagined to be 90°. Four such planed pieces of timber (4) are glued together with their bevelled sides against each other and the trapezium's short sides facing the middle of the elongated object (10) formed.

15 Claims, 1 Drawing Sheet

METHOD TO PRODUCE ELONGATED OBJECTS OF WOOD

The present invention concerns a procedure for producing elongated wooden objects, such as posts. The invention also concerns an elongated object produced according to the procedure.

The invention particularly concerns, but is not exclusive to, a procedure for producing wooden posts that primarily uses thin timber, i.e. timber with a major diameter of less than 10 cm. Today, wooden posts, especially those used for making frames, are made of wood laminates glued together to form boards, which means that they warp over time, i.e. they twist and bend. Such wooden posts can also be produced by mounting together four boards to make what is in principle a box. Its strength is limited and the box will split with time.

With the help of the invention, a wooden post that has high strength, that does not warp with time, that has the heart of the trunk facing the outwards, and that has few of the problems associated with knots, can be achieved. This is possible by the invention having the characteristics given in the claims.

Figure 1:
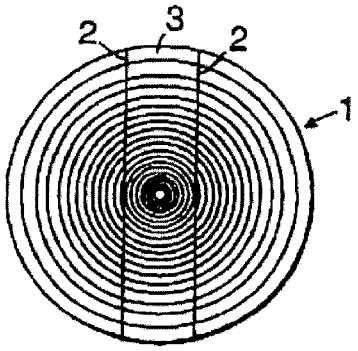
Figure 2:
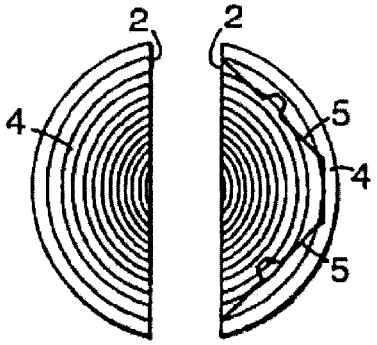
Figure 3:
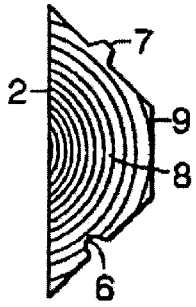
Figure 4:
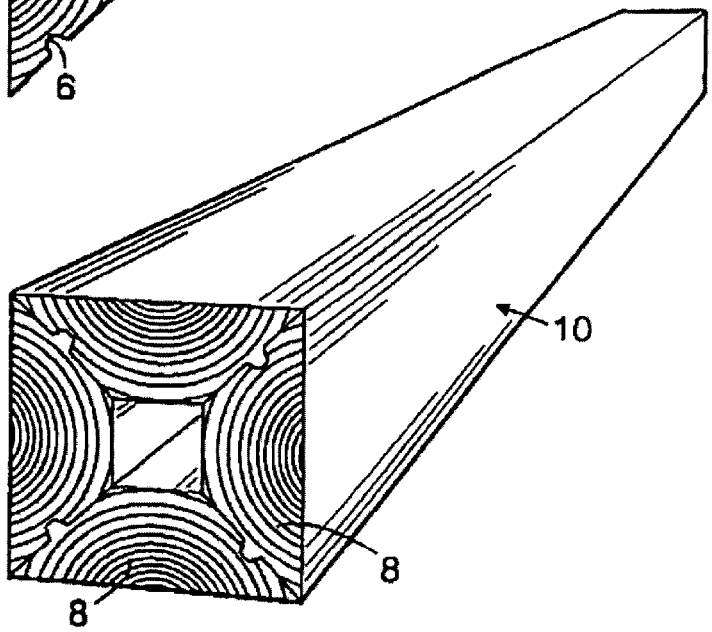

The invention will be described in greater detail in the form of an example with reference to the drawings, where FIG. 1 shows a schematic end view of round, unhewn timber—a tree trunk, FIG. 2 shows the rounded timber cleaved into two parts, FIG. 3 shows one of the parts of FIG. 2 planed to an isosceles trapezium in cross-section and FIG. 4 shows the elongated object made up of four pieces of timber obtained from two rounded pieces of timber.

Round, unhewn timber—a tree trunk 1—is cleaved down its length along two cleaved cuts 2. The cleaved cuts 2 are positioned so that The heart of the tree remains in the remnants 3. Following cleaving, two semi-circular pieces of timber 4 are obtained, see FIG. 2. The right-hand part of FIG. 2 shows two planing cuts 5 marked so that, together with the cleaved cut of the timber, they form a section that can be imagined to be a right-angled isosceles triangle. As can be seen more clearly in FIG. 3, which shows the section of Timber 4 planed according to the planing cuts 5 according to FIG. 2, the planed cut 5 has been provided with a groove 6 and tongue 7. By cleaving the tree trunk on either side of the heart, which is left in the remnants 3, the planed timber section 8 will not have a Triangular shape but the shape of an isosceles trapezium. If wished, the short side 9 can also be planed.

FIG. 4 shows the post 10 assembled from four finished planed pieces of timber 8. This figure shows clearly how the pieces of timber 8 are positioned with groove 6 and tongue 7 acting against each other. The planed surfaces are glued to each other, suitably by means of a continuous press. As such, which does not make up any part of the invention, post 10 can in principle be made as long as desired by placing an end-splicing mill prior to the gluing and the continuous press.

By means of the invention, a better saw yield with a glued post that does not twist or warp is obtained. The finished post has the heart of the trunk facing outwards, which gives a hard and even surface without the disturbance of knots and, since the timber dries successively and the cleaved side 2 with the heart of the trunk attempts to adopt a convex shape, with joints that are the subject of a self-tightening effect.

It should be understood that all sizes of rounded timber—tree trunks—can be used, but that the major benefits of the invention are, as noted, obtained with thin timber, i.e. timber with a major diameter of less than 10 cm. In the same way, the groove and Tongue are naturally not essential for production of the post. It can also be imagined that timber sections with profiles whose nose angles deviate from 90° could be cut from the Tree trunk, but in that case, a large part of the saw yield would be lost, which in the described example is about 70% compared with about 35% for making equivalent posts today.

What is claimed is:

1. A method of manufacturing an elongated rectangular cross-section post from round logs comprising:

cutting logs lengthwise using at least one cleaved cut to form two elongated semi-cylindrical cross-section timbers;

making a pair of bevel cuts on each of the elongated semi-circular cross-section timbers to form a board having an isosceles trapezium cross-section with a base formed by the cleaved cut and a pair of inwardly tapered sides formed by the beveled cuts oriented at a 90° angle relative to one another; and gluing the four isosceles trapezium boards together by joining adjacent beveled sides to form a rectangular box cross-section with the four cleaved cut base sides forming the outer periphery of the rectangle.

2. The method of claim 1 wherein cutting the pair of bevels further comprises forming a first bevel face provided with an elongated groove and forming a second bevel face provided with an elongated tongue with the tongue and groove of adjacent isosceles trapezium boards sized to cooperatively nest together.

3. The method of claim 1 wherein the cutting of the log lengthwise is achieved by making two parallel cleaved cuts centered about a heart of the log in order to form a planer board from the log and to eliminate the heart from the four cleaved cut base sides forming the outer periphery of the rectangular post.

4. The method of claim 1 further comprising planing a short side face on the isosceles trapezium board which is spaced from and parallel to the cleaved cut base side.

5. The method of claim 1 wherein the four isosceles trapezium boards forming the post are substantially identical to one another thereby forming a square cross-section post.

6. An elongated wooden post made by the method claim 1.

7. An elongated wooden post made by the method of claim 2.

8. An elongated wooden post made by the method of claim 3.

9. An elongated wooden post made by the method of claim 4.

10. An elongated wooden post made by the method of claim 5.

11. An elongated wooden post having a rectangular cross-section comprising:

four elongated boards which are glued together to form an elongated post having a rectangular box section, each of the boards having an isosceles trapezium cross-section resulting from the boards being cut from a relatively small diameter round log which has been cleaved cut lengthwise by at least one cleave cut to form a pair of semi-circular cross-section timbers, said timbers being planed to form an isosceles trapezium cross-section with the long side corresponding to the cleaved cut and a pair of double sides inwardly tapering from the long side inward warranted 90° relative to one another, wherein the beveled sides of the four adjacent boards are glued together to form a rectangular cross-section with the four cleaved cut sides facing the outer periphery of the post.

12. The elongated wooden post of claim 11 wherein the isosceles trapezium boards are formed from round logs having a major diameter of less than 10 cm.

13. The elongated wooden post of claim 11 wherein each of the isosceles trapezium cross-section boards has a first beveled face which is provided with an elongated groove and a second beveled face with is provided with an elongated tongue wherein the tongue and groove of adjacent isosceles trapezium boards cooperatively nest within one another.

14. The elongated wooden post of claim 11 wherein the round log is cleaved cut by two spaced apart parallel cuts on opposite sides of a heart of the log forming a planer board containing the heart of the log and the two semi-circular cross-section timbers from which the isosceles trapezium boards are planed, wherein the resulting four cleaved cut sides forming the outer periphery of the post being are free of the log heart.

15. The elongated wooden post of claim 14 wherein the length of the cleaved cut side of the board is sufficiently large relative to the small diameter of the round log that the yield resulting from the use of the two isosceles trapezium boards and the planer cleaved cut board formed by cutting the log results in a usage of about 70% of the wood in the log enabling a relatively large post to be fabricated using small diameter logs.

* * * * *

UNITED STATES PATENT AND TRADEMARK OFFICE

CERTIFICATE OF CORRECTION

PATENT NO. : 6,164,027
DATED : December 26, 2000
INVENTOR(S) : Ulf Ohlund

It is certified that error appears in the above-identified patent and that said Letters Patent is hereby corrected as shown below:

Column 3, claim 13,
Line 10, after the word "face", delete the word "with" and insert -- which -- in its place;

Column 4, claim 14,
Line 4, after the word "post", delete the word -- being --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*